US006047659A

United States Patent [19]

Schmidt, Jr.

[11] Patent Number: 6,047,659

[45] Date of Patent: Apr. 11, 2000

[54] MOUNTING APPARATUS FOR A LIFT ASSEMBLY

[76] Inventor: Anthony P. Schmidt, Jr., 11753 Terra Bella Blvd., Plantation, Fla. 33325

[21] Appl. No.: 08/960,589

[22] Filed: Oct. 30, 1997

[51] Int. Cl.[7] ..... B63B 23/02

[52] U.S. Cl. ..... 114/369

[58] Field of Search ..... 114/258, 259, 114/366, 369, 370, 44, 48

[56] References Cited

U.S. PATENT DOCUMENTS

| | | | |
|---|---|---|---|
| 1,900,905 | 3/1933 | Bowden | 114/369 |
| 2,761,571 | 9/1956 | Adams | 114/366 |
| 4,627,377 | 12/1986 | Zoonens | 114/366 |
| 5,544,606 | 8/1996 | Schmidt, Jr. | 114/366 |

FOREIGN PATENT DOCUMENTS

| | | | |
|---|---|---|---|
| 26187 | 2/1987 | Japan | 114/259 |

*Primary Examiner*—Ed Swinehart
*Attorney, Agent, or Firm*—Richard S. Ross, Esq.

[57] ABSTRACT

A mounting apparatus comprises a plurality of main support tubes securely affixed to the transom and substantially hidden within the hull of a marine vessel. The number of main support tubes corresponds with the number of support units of a lifting device. Each of the support units further comprises a plurality of support members where the uppermost support member is secured to a corresponding main support tube. The main support tubes are housed through the transom and below the deck or flooring of the vessel so that when the support members are retracted, they are concealed, or substantially concealed, within the main support tubes.

12 Claims, 4 Drawing Sheets

MOUNTING APPARATUS FOR A LIFT ASSEMBLY

FIELD OF THE INVENTION

The present invention relates to a mounting apparatus for a lift assembly. More particularly, the present mounting device is secured to the transom of a boat for mounting a retractable personal water craft or dinghy lifting device thereon.

BACKGROUND OF THE INVENTION

Boat lifting devices have been used in the marine industry to attach to a larger vessel to raise and lower personal water craft or smaller craft such as a dinghy into and out of the water. These devices are typically secured to the transom of the larger vessel.

The inventor herein is also the inventor of two patents which relate to boat lifting devices: Schmidt, Jr., U.S. Pat. No. 4,878,450 and Schmidt, Jr., U.S. Pat. No. 5,544,606. Both of these Schmidt, Jr. inventions relate to novel means for raising and lower personal water craft into and out of the water. The referenced patents employ the respective inventions in a marine environment, either on the transom of a larger vessel or attached to a dock. Other patents disclosing lifting means comprise references to Adams, U.S. Pat. No. 2,761,571; Holt, U.S. Pat. No. 3,421,723, and; Glenn et al., U.S. Pat. No. 4,232,627.

The price of larger boats, for example, boats whose length is forty feet and longer, and which can accommodate a boat lifting device as disclosed herein, is very expensive easily costing more than one million dollars. The finest components are used to build such vessels. One drawback of the prior art lifting devices heretofore mentioned includes the unsightly view of their components. It is undesirable when building such expensive boats to have an aesthetically displeasing finish by allowing the components of a lifting device to be seen when the device is retracted out of the water. It would be desirable to hide the components and mechanics of a lifting device unlike the prior art in which such components are always in full view.

SUMMARY OF THE INVENTION

A mounting apparatus comprises a plurality of main support tubes securely affixed to the transom and substantially hidden within the hull of a marine vessel. The number of main support tubes corresponds with the number of support units of a lifting device. Each of the support units further comprises a plurality of support members where the uppermost support member is secured to a corresponding main support tube. The main support tubes are housed through the transom and below the deck or flooring of the vessel so that when the support members are retracted, they are concealed, or substantially concealed, within the main support tubes. In an alternative embodiment, a portion of the main support tubes might extend above the vessel's deck, however, it is still cloaked by a device such as a bait well or ice chest permanently built onto the vessel. Still another embodiment houses the main tube supports into a land based dock or sea wall.

It is thus an object of the present invention to incorporate the lifting device into the transom of a boat such that only the lift assembly platform can be viewed by an observer when the assembly is fully retracted.

It is another object of the present invention to be able to hide the lifting device support members from casual view when a lifting device is attached to a transom of a vessel and the lifting device is in its retracted state.

It is another object of the present invention to provide a retractable lifting device for securement onto a dock or sea wall such that the support members of the lifting device are substantially hidden from view when the device is in its retracted state.

Further objects and advantages of this invention will become apparent from the description and claims which follow.

BRIEF DESCRIPTION OF THE DRAWINGS

The features embodying the present invention are illustrated in the accompanying drawing, forming a part of this application, in which.

DETAILED DESCRIPTION OF THE PREFERRED EMBODIMENT

Figure 1:
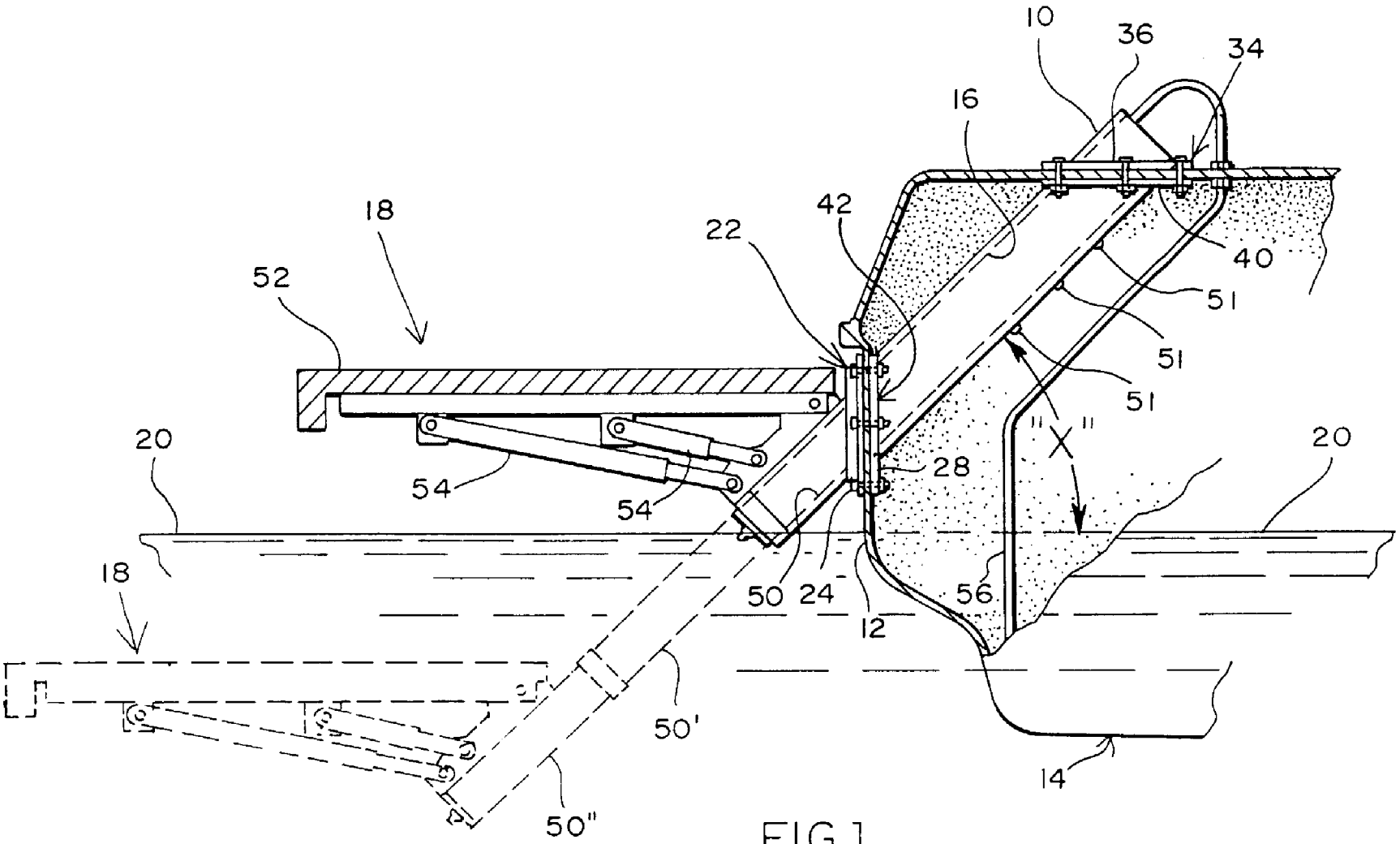
FIG. 1 is a side view of the present invention attached to the transom of a marine vessel.

Referring to FIG. 1, the present invention is illustrated. Specifically, main support tube 10 is housed onto the transom 12 of a vessel 14. The main support tube 10 is manufactured of a non corrosive material to better ward off the elements of a marine environment. It is preferred to manufacture the main support tube of a metal such as aluminum, stainless steel or brass.

Figure 3:
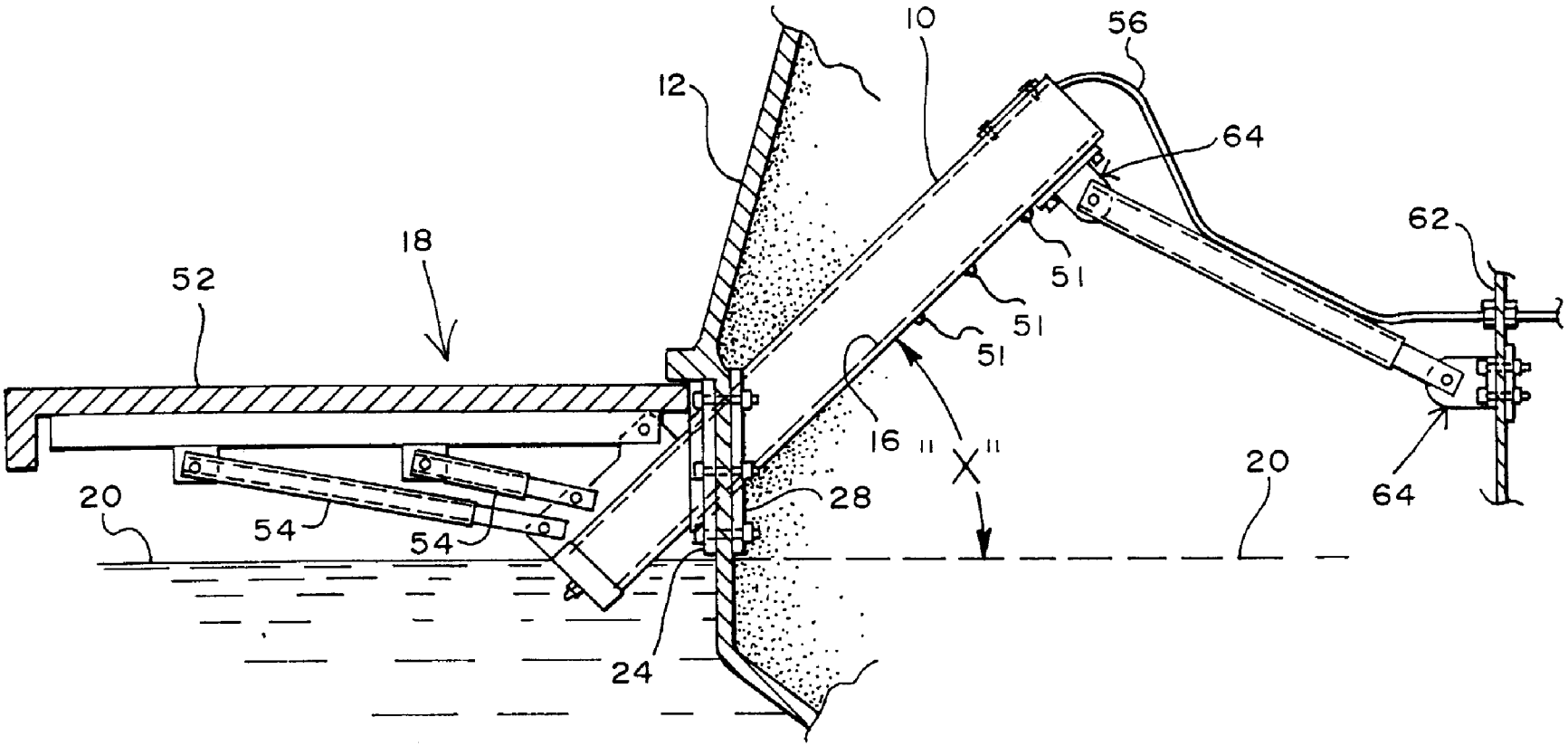
FIG. 3 is an alternative embodiment of the present invention illustrating a modified means of securing the invention to a marine vessel.

Different vessel 14 makes will dictate the location by which the main support tube 10 is secured to the vessel. This is because vessel manufacturing is not universally specified. Thus, different transom 12 shapes and hull spaces are possible. Therefore, FIG. 1 depicts one location for securing the main support tube 10 to the vessel 14. Likewise, FIG. 3 depicts another location and method for securing the main support tube 10 to the vessel 14.

Notwithstanding the foregoing, the main support tube 10 is configured to accept a support unit 16 of a lifting device 18. As depicted, the support unit 16 is substantially rectangular in cross sectional shape and thus the main support unit 10 has a corresponding cross section.

The main support tube 10 is secured to the vessel 14 at at least two points. The first point of attachment of the main support tube 10 is at the transom 12 and above the water line 20. A hole is cut through the transom of sufficient size to permit the main support tube 10 to fit therethrough. A first face plate assembly 22 is comprised of a front face plate 24 having a flange 26 and a rear face plate 28 having a flange 30. The front face plate 24 is placed about the hole along the outside of the transom 12 and the rear face plate 26 is placed along the inside of the transom 12 at the opposed side of the hole cut therethrough. The front face plate 24 and rear face plate 28 are then secured together along their respective flanges, 26 and 30, by means of a plurality of nuts and bolts.

Figure 2:
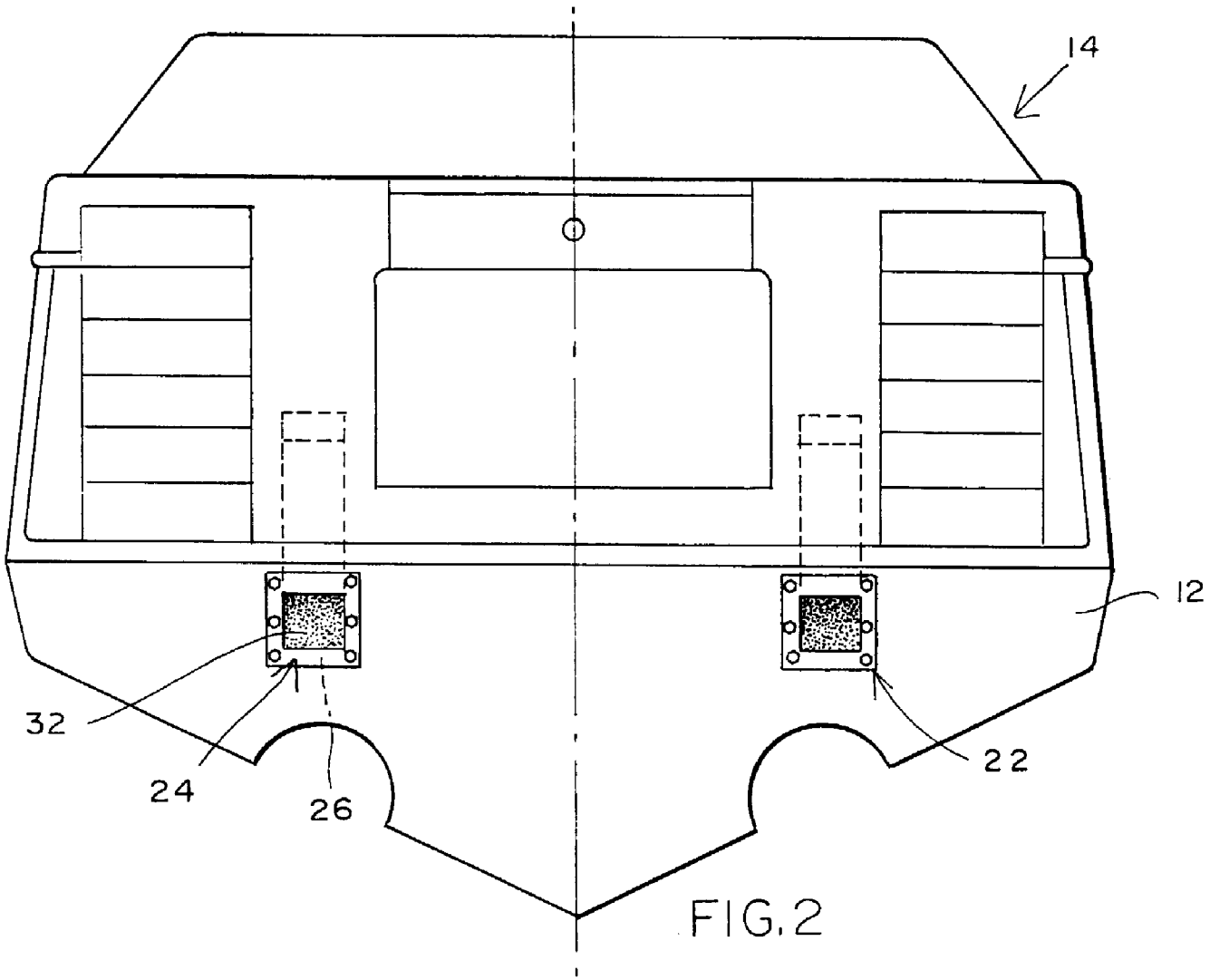
FIG. 2 is a back view of a transom of a marine vessel showing the present invention in place.

The first face plate assembly 22 forms an aperture 32 through which the main support tube 10 fits, and also through which a support unit 16 of the lifting device 18 may be inserted. Most vessel manufacturers apply a slight radius to the transom 12. If this is the case for a particular installment, the aperture 32 will have to be angled accordingly so that parallelism can be maintained with respect to a plurality of main support tubes. As shown best in FIG. 2, the substantially rectangular cross section of the aperture is angled into a quadrangle configuration.

A second face plate assembly 34 is comprised of a top face plate 36 having a flange 38 and a bottom face plate 40 having a flange 42 as a second point of attachment of the main support tube 10 to the vessel 14. The top face plate 36 is placed above a hole cut through the deck or flooring of the vessel 14, and the bottom face plate 40 is attached along the underside of the decking of the vessel 14 at the opposed side of the hole cut therethrough. The top face plate 36 and bottom face plate 40 are then secured together along their respective flanges, 38 and 42, by means of a plurality of a nuts and bolts.

A main support tube 10 can be precast to terminate at its opposed ends with a rear face plate 28 at one end, and a bottom face plate 40 at the other end. In the alternative, a main support tube 10 can have welded onto its opposed ends the respective plates, 28 and 40. If a main support tube 10 is inserted into a hole cut through the decking of the vessel 14, and a portion of the main support tube 10 extends beyond the decking, the top face plate 36 can be welded thereon. That portion of the main support tube 10 that extends beyond the decking can be hidden from view by placing a built-in bait well (not shown), ice chest (not shown), or other such device thereon.

A main support tube 10 requires, upon installation, an angling with respect to the water line 20 so that the tube can best be substantially concealed within the hull of the vessel 14. It is best if angle X is in a range of 15 to 52 degrees. A preferred angle X range however is from 30 to 40 degrees. Further, in order to practice this invention, at least one main support tube 10 can be used. However, the preferred embodiment dictates that two main support tubes 10 be employed for better stability and balance of the lifting device 18 (See FIG. 2A). In addition, the invention can also be practiced by attaching the mounting apparatus to a dock or sea wall (not shown).

The lifting device 18 is comprised of a plurality of support units 16 as heretofore disclosed. Each support unit is comprised of a plurality of telescoping, retractable, interconnected support members, 50, 50' and 50", preferably three in number. The uppermost support member 50 is permanently secured to the inside of a main tube support 10 by bolts 52. A lift platform 52 is supported on the lowermost support member 50" by brackets 54. Means for extending and retracting the support members comprise hydraulic cylinders secured to the interior of the support members and directly to the uppermost support member 50 and the lowermost support member 50" (not shown and best described in U.S. Pat. No. 5,544,606, FIG. 7) connected by a hose 56 and driven by a pump (not shown).

Figure 2A:
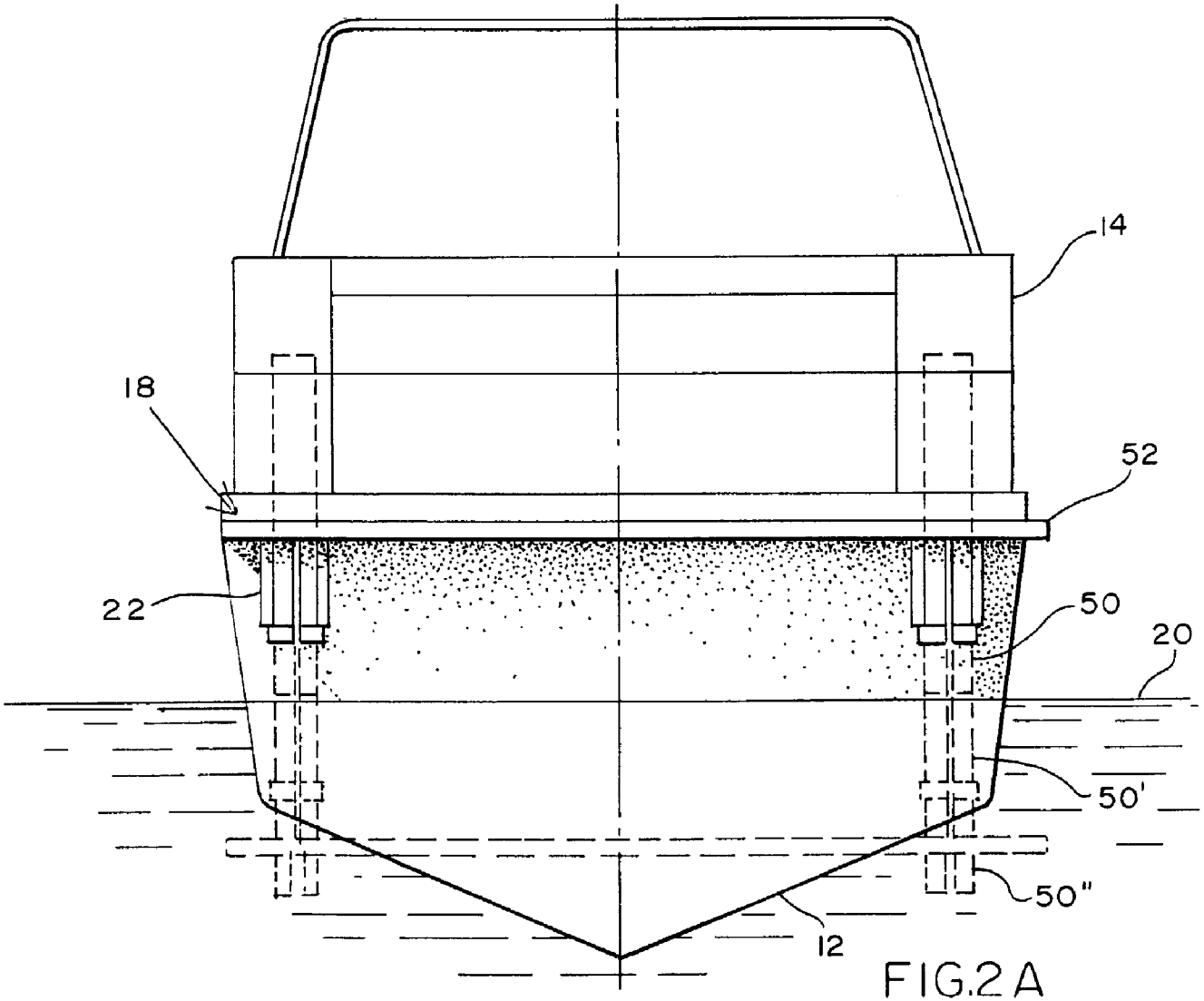
FIG. 2A is a back view of a transom of a marine vessel showing the present invention with an installed lifting device in place.

FIGS. 1 and 2A depict the support members, 50, 50', and 50", as well as the platform 52, in phantom lines, fully extended. The platform 52 not depicted in phantom lines shows the lifting device 18 in retracted form. Furthermore, with respect to FIG. 2A, the preferred number of support units 16 comprise two to comport with the preferred number of main support tubes 10 in the preferred embodiment of the present invention.

FIG. 3 discloses an alternative embodiment for securing the second point of attachment of the main support tube 10 to the vessel 14. This alternative embodiment, and others, will be dictated by the construction of the vessel 14 and the available space about the transom 12. In FIG. 3, a backing tube support 60 connects the main support tube 10 to a bulkhead 62 or stringer (not shown) by a pair of t-plate assemblies 64. Other means of securing the main support tube 10 to the vessel 14 can be employed as dictated by the make and space availability of the vessel 14.

It is intended that the description of the preferred embodiments of this invention is illustrative only. Other embodiments of the invention that are within the scope and concept of this invention are herein included within this application.

What is claimed is:

1. A marine vessel having a bulkhead in combination with a lifting device mounting apparatus for said vessel, said mounting apparatus comprising a plurality of main support tubes secured to the transom of said vessel above the waterline and substantially within the hull of said vessel, and said lifting device comprising a plurality of support units each comprising a plurality of retractable and interconnected support members, and means for securing said support units to and within said main support tubes such that said support members retract and extend through said transom.

2. The vessel of claim 1, wherein a first face plate assembly secures the main support tube to the transom forming a first point of attachment of the main support tube to the transom.

3. The vessel of claim 1 having a face plate assembly for securing the main support tube to the decking of said vessel.

4. The vessel of claim 1 comprising two main support tubes and two lifting device support units.

5. The vessel of claim 1 wherein the main support tube is angled with respect to the water line of a body of water upon which sits the said vessel in a range of 15 to 52 degrees.

6. The vessel of claim 1 wherein the main support tube is angled with respect to the water line of a body of water upon which sits the said vessel in a range of 30 to 40 degrees.

7. The vessel of claim 1 wherein the support members number three.

8. The vessel of claim 1 wherein one support member is secured to the main support tube.

9. The vessel of claim 1 wherein a point of attachment of said main support tube to said vessel is by bracket and support means to the bulkhead thereof.

10. The vessel of claim 1 wherein a second point of attachment of said main support tube to said vessel is by bracket and support means to the stringer thereof.

11. The vessel of claim 1 wherein the said lifting device has a platform for raising, holding and carrying personal watercraft thereon.

12. A lifting device mounting apparatus for a marine vessel, said mounting apparatus comprising a plurality of main support tubes secured to the transom of said vessel above the waterline and substantially within the hull of said vessel, and said lifting device comprising a plurality of support units each comprising a plurality of retractable and interconnected support members, and means for securing said support units to and within said main support tubes such that said support members retract and extend through said transom.

* * * * *